US006963280B2

(12) United States Patent
Eskildsen

(10) Patent No.: US 6,963,280 B2
(45) Date of Patent: Nov. 8, 2005

(54) DOOR SECURITY DEVICE FOR USE IN SECURITY SYSTEMS

(75) Inventor: Kenneth G Eskildsen, Great Neck, NY (US)

(73) Assignee: Honeywell International Inc., Morristown, NJ (US)

( * ) Notice: Subject to any disclaimer, the term of this patent is extended or adjusted under 35 U.S.C. 154(b) by 303 days.

(21) Appl. No.: 10/462,449

(22) Filed: Jun. 16, 2003

(65) Prior Publication Data

US 2004/0257215 A1 Dec. 23, 2004

(51) Int. Cl.[7] ..... E05B 45/06

(52) U.S. Cl. ..... 340/542; 340/545.1; 340/527; 340/5.28

(58) Field of Search ..... 340/542, 545.1, 340/527–530, 506, 5.28, 5.1, 5.2

(56) References Cited

U.S. PATENT DOCUMENTS 4,370,644 A 1/1983 Droz
4,640,110 A * 2/1987 Fish et al. ..... 70/269
4,845,471 A 7/1989 Chu
4,970,494 A * 11/1990 Keely et al. ..... 340/567
5,003,290 A * 3/1991 Lindquist et al. ..... 340/545.1
5,311,168 A 5/1994 Pease, Jr. et al.
6,225,903 B1 5/2001 Soloway et al.
6,812,836 B2 * 11/2004 Soloway et al. ..... 340/542

* cited by examiner

*Primary Examiner*—Daniel Wu
*Assistant Examiner*—Sihong Huang
(74) *Attorney, Agent, or Firm*—Anthony R. Barkume, P.C.

(57) ABSTRACT

A door entry security device used in a security system including a control panel, the door security device in a housing suitable for mounting within a recess of a doorjamb or door of a premises. In the housing is a lock position detecting switch, adapted to detect the position of a lock mounted on a door as being either locked or unlocked, a door position detecting switch adapted to detect the position of the door as being either open or closed, and processing circuitry adapted to generate a security system disarm signal when (1) the position of the lock has transitioned from a locked state to an unlocked state, (2) the door is closed at the time that a predefined time period has elapsed since the position of the lock transitions from a locked state to an unlocked state, and (3) the door has been opened after that predefined time period has elapsed. The door entry device also has a data transmitter for sending the security system disarm signal to the control panel. An alarm signal is generated and transmitted to the control panel when the door is open at the time that the predefined time period has elapsed since the lock has transitioned to an unlocked state. The control panel prevents the security system from being disarmed when an alarm signal is received unless a user code is entered into the security system.

48 Claims, 5 Drawing Sheets

2

DOOR SECURITY DEVICE FOR USE IN SECURITY SYSTEMS

FIELD OF THE INVENTION

This invention relates to security systems, and in particular to a security device that operates in conjunction with an entry door to selectively arm and/or disarm the security system in an automatic manner.

BACKGROUND OF THE INVENTION

Alarm systems monitor sensors to determine the presence of people within a protected space. If the alarm system detects a breach of the protected space it will respond based on the state of the system. Possible system states include "disarmed", "armed stay", and "armed away." If the system is disarmed it will not cause an alarm due to a breach of perimeter or interior sensors. If the system is armed stay, it will alarm due to a breach of the perimeter sensors, but not due to a breach the interior sensors. If the system is armed away it will alarm based on a breach of the perimeter or interior sensors. The state of the system is determined by the needs of the occupants of the premises. If all of the occupants are leaving the premises then the system should be armed away. If the occupants will be staying within the premises for an extended period of time then the system should be armed stay. For all other scenarios the system should be disarmed.

Problems arise when the system is not properly armed and disarmed. Typical problems include not disarming the system before the alarm sounds, arming away when occupants plan to stay within the protected space, and not arming the system when the premises are unoccupied. These are user created problems and as such, it is desirable to develop a system that will assist the end user with the arming and disarming operations.

Others have attempted to provide partial improvement by offering security systems that will assist the end user with arming and disarming. One such system, as described in U.S. Pat. No. 6,225,903, is armed and disarmed by the action of the deadbolt on the entry door. A switch is mounted in the doorjamb to detect when the bolt is extended into the jamb, i.e. locked. If the deadbolt is locked and the alarm system does not detect motion within a predetermined exit time, then the system will transition to the armed away state. If motion is detected then it will transition to the armed stay state. If the system is armed and the deadbolt is unlocked, then the system will transition to the disarmed state. A major drawback with this arrangement occurs when the door is forced open (i.e. a "kick-in" by an intruder) and the bolt disengages from the jamb switch without the use of a key. Although this is an unauthorized entry, the alarm system will disarm allowing the perpetrator full access to the premises.

SUMMARY OF THE INVENTION

The present invention therefore pertains to a security system arming and disarming arrangement that consists of a wireless door security device and a security console (i.e. control panel). The wireless door security device is mounted in the doorjamb (or door) of an entryway of the premises to be protected and is used to monitor the condition of the door. The door security device has a contact switch to monitor when the deadbolt (or other type of door lock) is locked or unlocked, and it has a magnetic reed switch to monitor when the door is opened or closed. These two inputs are monitored by a microcontroller to determine that the sequence that occurs when the door is opened or closed is consistent with a normal entry or exit. For example, the deadbolt should be unlocked before the door is opened. If the door and the deadbolt open the same time (or within a certain short predefined time) then the door is considered to have been pried or kicked open. Based on the sequence detected by the microcontroller, an RF transmission will be sent to the control panel directing it to arm, disarm, or alarm. The security console is used to modify the arming operation. By pressing a single button on the console, the user can direct the security system to arm stay or arm away when receiving the arming command from the wireless sensor.

This arrangement solves the assisted security system interface problem in several ways. It provides a means to arm and disarm the security system with a minimum of intervention from the end user. It provides a means to ensure that the system is armed when needed, eliminating the unoccupied and unarmed premises problem. It provides a means to reliably disarm the system to eliminate entry delay false alarms. It also provides a means to detect forced entry and sound the alarm instead of disarming like those in the prior art.

The present invention effectively provides a means for assisted arming and disarming of security panels consistent with the functional requirements of these systems in contrast with prior art systems which compromise the scope of assisted security system arming.

Thus, the present invention is a door entry security device suitable for use in a security system, and a method of operating the door entry security device for automatically disarming and arming the security system. The security system includes a control panel for controlling operation of the security system and at least one door entry security device that includes a housing suitable for mounting within a recess of a doorjamb of a premises or within the door itself. In the housing is a lock position detecting switch, adapted to detect the position of a lock mounted on a door associated with the doorjamb as being either locked or unlocked with respect to the doorjamb. A door position detecting switch is also within the housing, which is adapted to detect the position of the door as being either open or closed with respect to the doorjamb and to generate a door status signal that indicates whether the door has been detected as being open or closed. Processing circuitry is adapted to generate a security system disarm signal when (1) the lock position detecting switch indicates that the position of the lock has transitioned from a locked state to an unlocked state, (2) the door status signal indicates that the door is closed at the time that a predefined time period (e.g. 100 msec) has elapsed since the position of the lock is sensed to have transitioned from a locked state to an unlocked state, and (3) the door status signal indicates that the door has been opened after that predefined time period has elapsed. The door entry device also has a data transmitter (preferably wireless) for sending the security system disarm signal to the control panel.

An alarm signal is generated and transmitted to the control panel by the door security device when the door status signal indicates that the door is open at the time that the predefined time period has elapsed since the lock has transitioned to an unlocked state. The control panel prevents the security system from being disarmed when an alarm signal is received unless a user code is entered into the security system, such as by a keypad or a portable wireless keyfob.

In one embodiment, the processing circuitry is adapted to set a disarm ready flag when the door status signal indicates that the door is closed at the time that the predefined time period has elapsed since the lock position detecting switch indicates that the position of the lock has transitioned from a locked state to an unlocked state. In this embodiment, the disarm ready flag must be set in order for the security system disarm signal to be generated. The disarm ready flag will be cleared if the lock position detecting switch indicates that the position of the lock has transitioned from an unlocked state to a locked state before the door status signal indicates that the door has been opened.

The present invention may also be used to arm the security system as well as disarm it. A security system arming signal is generated when the position of the door is detected as being closed and the lock position detecting switch indicates that the position of the lock has transitioned from an unlocked state to a locked state. The control panel then disarms the security system on receipt of the security system disarm signal, unless the security system is already in an alarmed state.

DETAILED DESCRIPTION OF THE INVENTION

Figure 1:
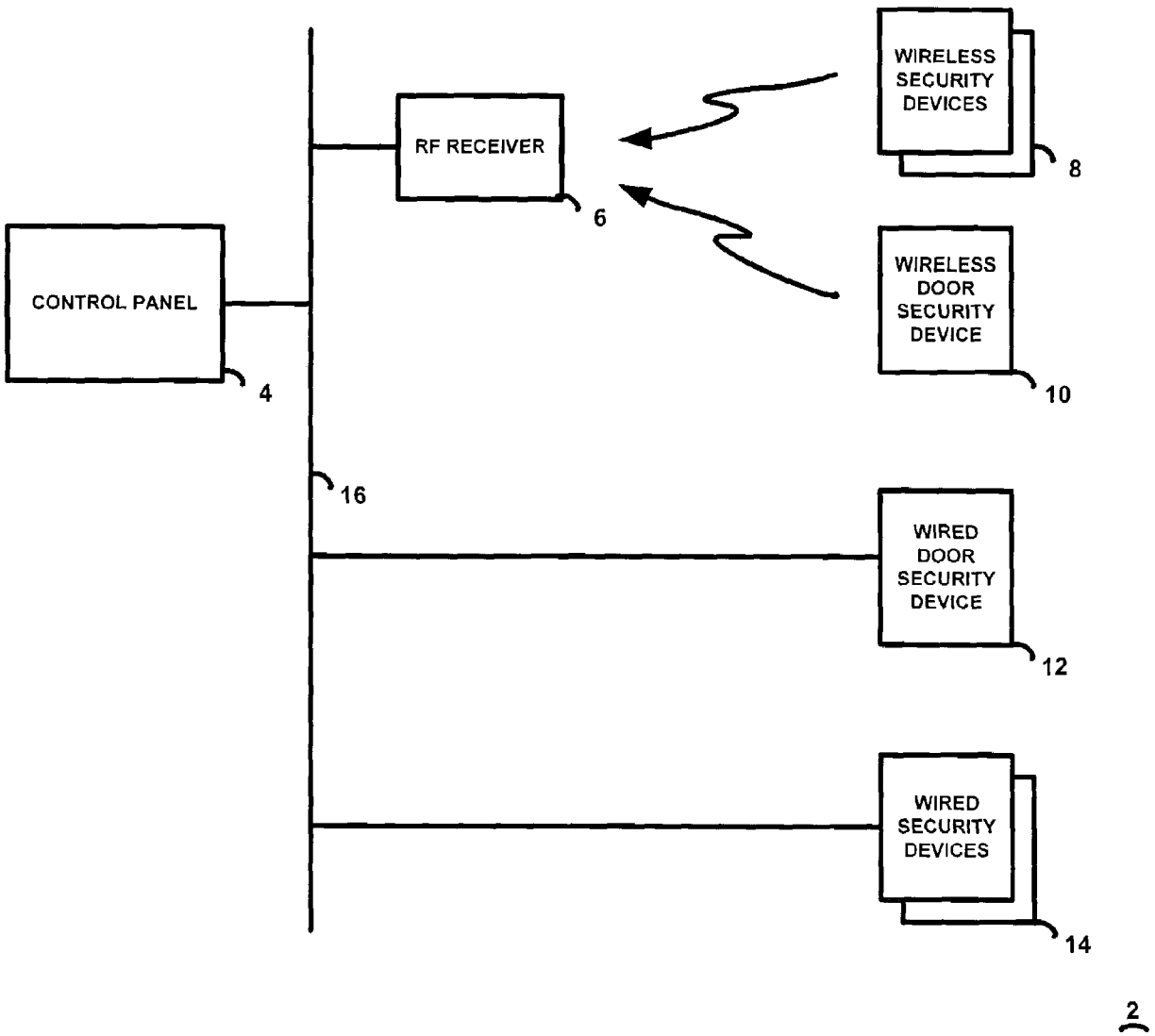
FIG. 1 is a block diagram of the preferred embodiment of the present invention.

The preferred embodiment of the present invention will now be described with respect to the Figures. FIG. 1 illustrates a block diagram of a security system 2 having a control panel 4 connected by a security system bus 16 to one or more wired security devices 14 as well known in the art. Security devices 14 may include, for example, a passive infrared (PIR) sensor for sensing motion of a protected volume of space, a smoke or heat detector, a glass break sensor, and the like. In addition, an RF receiver 6 is connected to the control panel 4, and provides wireless communications with wireless security devices 8 as well known in the art. These wireless security devices may also be PIR sensors, glass break sensors, etc. The control panel 4 operates as known in the art (except as modified in accordance with the present invention to interoperate with the door security devices described herein), including processing of alarm signals from the various security devices, arming the system, disarming the system, providing system status, etc.

Also shown in FIG. 1 are a wireless door security device 10 and a wired door security device 12, which differ only in the manner that they communicate with the control panel 4 (i.e. the wireless door security device communicates by wireless link to RF receiver 6 and the wired door security device communicates by wired bus 16). These devices will therefore be referred to generically as door security devices throughout this specification. A security system may have one door security device, or it may have a plurality of such devices, with each located strategically at a selected entry door of the premises being monitored.

Figure 2:
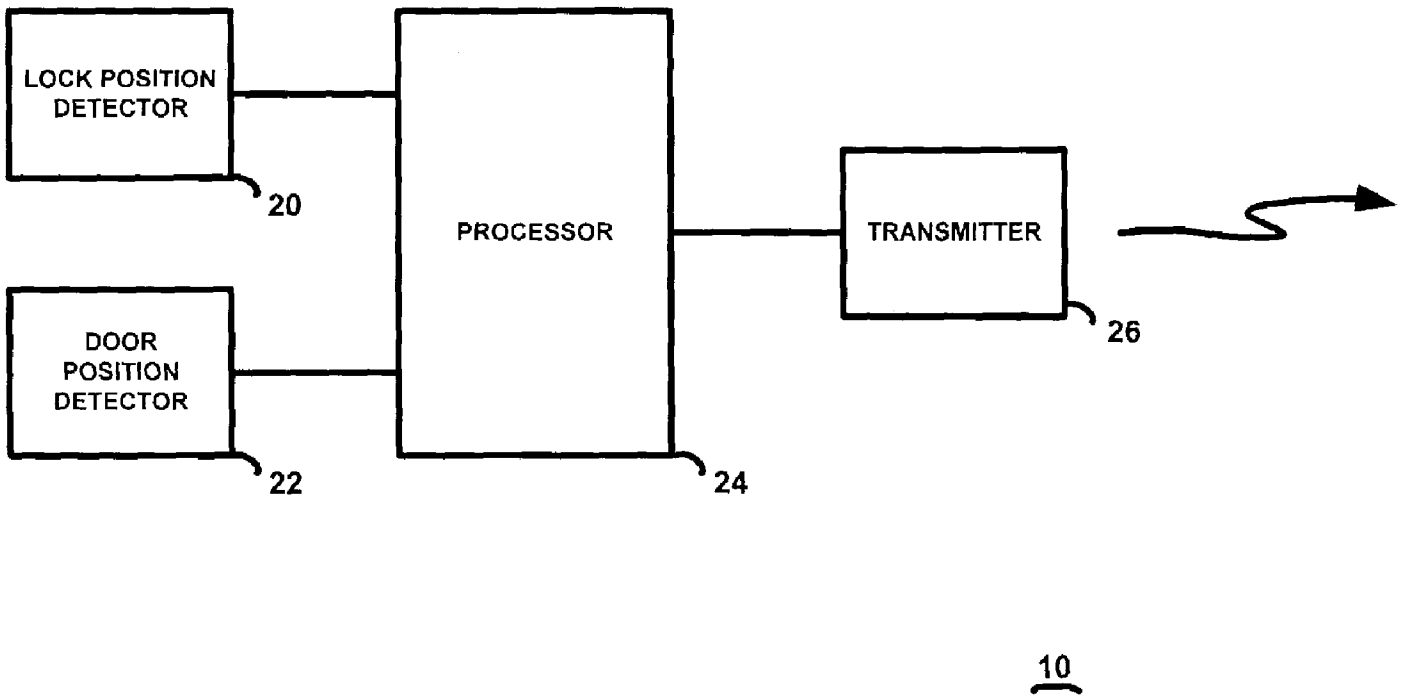
FIG. 2 is a detailed block diagram of the door entry security device of the preferred embodiment of the present invention.
Figure 3:
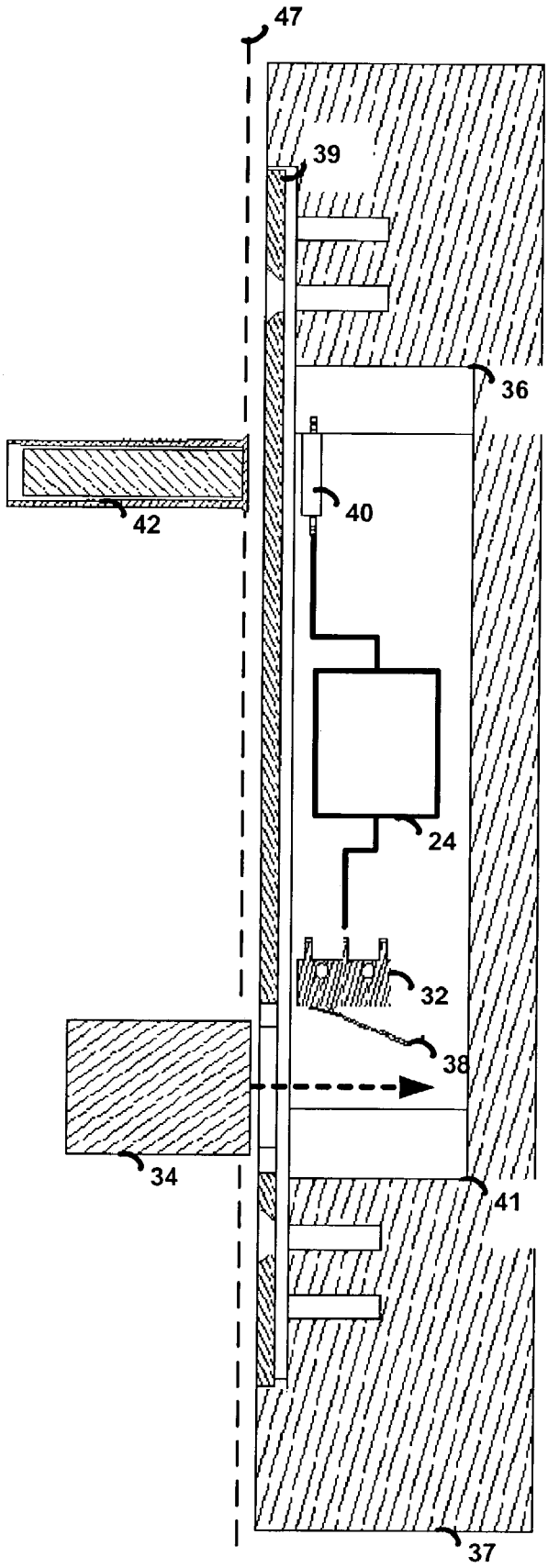
FIG. 3 is an illustration of the door entry security device mounted in a doorjamb.

A block diagram of the door security device is illustrated in FIG. 2. The major components of the door security device are a lock position detector 20, a door position detector 22, processing circuitry 24, and a data transmitter 26, which may be an RF wireless transmitter or a wired transmitter as previously explained. As shown in FIG. 3, these components are suitably mounted within a housing 36 that is preferably adapted to fit within a recess of a doorjamb 37, in particular within the recess 41 otherwise occupied by a bolt cup and strike plate 39 as shown in FIG. 3. Thus, in the preferred embodiment, the door security device may be obtained and inserted in the pre-existing recess of a doorjamb as a retrofit by an installer or by a homeowner. If a wireless door security device 10 is used, then no further wiring is necessary. If a wired door security device 12 is used, then the installer must also run a wire(s) from the housing 36 to the bus 16 as known in the art. Thus, the preferred embodiment utilizes a wireless transmitter for ease of installation in the doorjamb. In an alternative embodiment, the door security device is mounted in the door itself rather than the doorjamb. The present invention has applicability in both the doorjamb-mounted and the door-mounted embodiments.

The lock position detector 20 may operate to determine the position of a deadbolt or of a standard entry lock, as desired by the user. That is, by simply mounting the housing in the desired doorjamb recess, the security system may be controlled by the selected door lock mechanism. The door lock may be key operated, swipe card, combination lock, etc. In the preferred embodiment, the device is used to sense the position of a deadbolt since using it with a standard entry lock recess would arm the system every time the door is closed (as described below).

The lock position detector, as shown in FIG. 3 in the preferred embodiment, is a mechanical contact switch 32 that is well known in the art and can sense the presence of the bolt 34 within the housing 36 (i.e. detect if the lock is locked or unlocked). The housing 36 receives the bolt 34 as it is extended by operation of the locking mechanism on the door 47 into the locked position. When the bolt is in the locked, or extended, position, then the arm 38 on the contact switch 32 is caused to close, and a DOOR LOCKED signal is generated by the contact switch 32 and input to the processor 24. When, however, the bolt is retracted into the door (or otherwise leaves the housing 36, which may be by forced entry), then the arm 38 opens and the DOOR LOCKED signal changes state to DOOR UNLOCKED, which is input to the processing circuitry 24. For example, the DOOR UNLOCKED signal may be an interrupt to a microprocessor that will cause it to enter certain processing routines as further described. Thus, the transition of the bolt from a retracted state (unlocked) to an extended state (locked) is communicated to the processor 24, as is the transition of the bolt from an extended state (locked) to a retracted state (unlocked). Other types of position detecting mechanisms may be used to detect the position of the bolt in addition to the contact switch embodiment described herein, such as a magnetic reed switch, optical detectors, etc.

The door position detector, in the preferred embodiment, is also mounted within the housing 36 to provide a status signal that indicates if the door is closed (substantially aligned with the doorjamb) or open with respect to the doorjamb. A magnetic reed switch mechanism 40 may be used, for example, to provide such status signals. A magnet 42 is located within the door 47 so that it causes the reed switch 40 to change states when the door is brought into substantial alignment with the doorjamb as well known in the art. Thus, when the door is closed in the doorjamb, then a DOOR CLOSED signal is generated by the reed switch 40 and sent to the processing circuitry 24. Correspondingly, when the door is opened, the DOOR CLOSED signal changes state to DOOR OPEN, which is input to the processor. For example, the DOOR OPEN signal may be an interrupt to a microprocessor that will cause it to enter certain processing routines as further described. Other types of door position detecting mechanisms may be used to detect the position of the door in addition to the reed switch embodiment described herein.

Note that although the preferred embodiment uses a single signal (with 2 states) to indicate the status of the door latch (and one for the door position), other types of signals may be used (i.e. discrete lines for each state) as well.

In distinction to the prior art systems described above, in which alarm systems are armed or disarmed simply on the position of the deadbolt, the present invention utilizes intelligence to analyze the position of the lock as well as the position of the door and then control the security system in a more secure and robust manner as now described.

Figure 4:
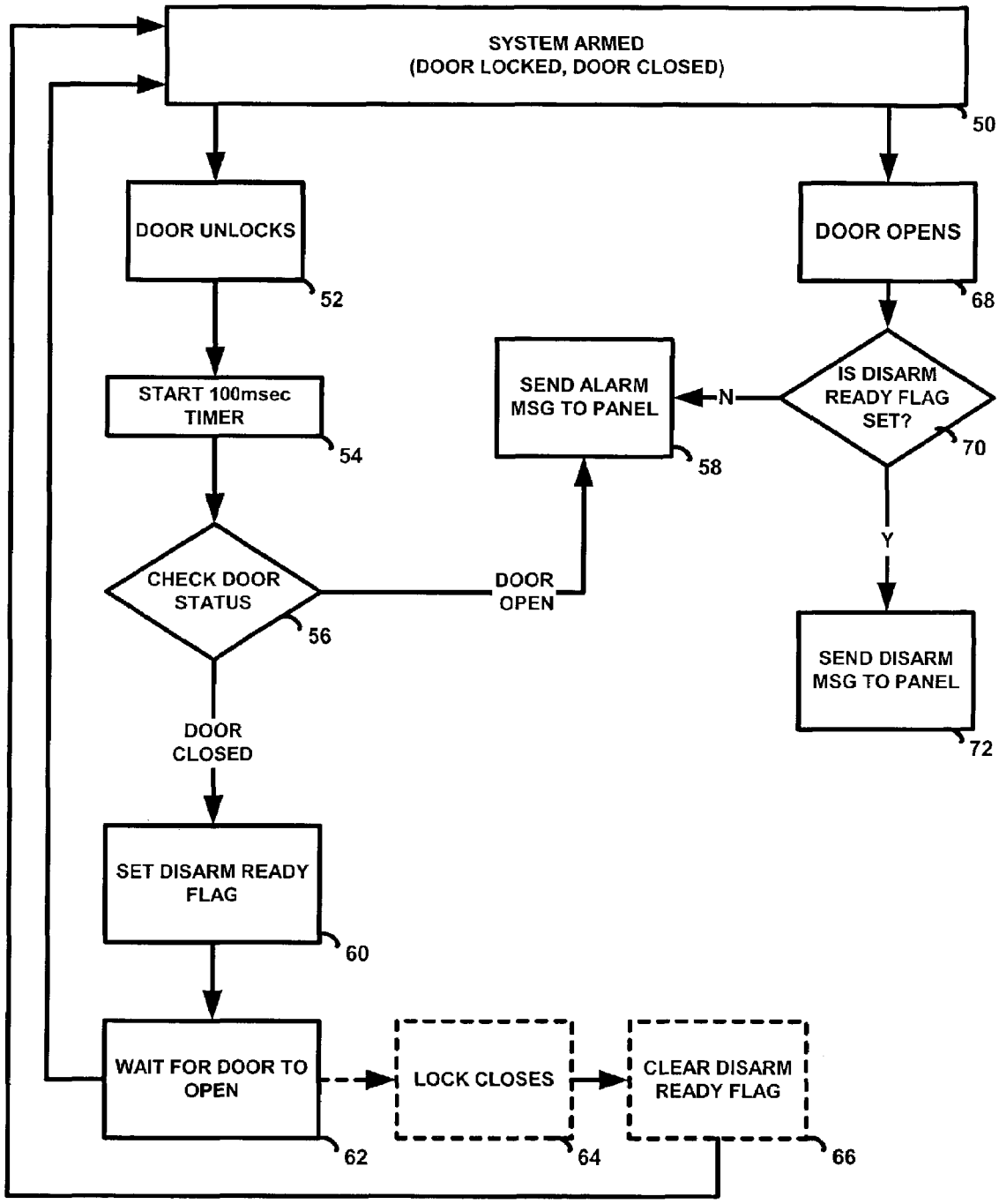
FIG. 4 is a flowchart of the disarm operation of the present invention.

With respect to FIG. 4, in the first scenario, the security system is in the armed state (step 50), which means that the activation of any of the security devices 8, 10, 12, 14 will generally cause an alarm signal to be generated, and certain defined actions to be taken (such as sounding a siren, dialing a central station, etc.). One feature of the present invention is to allow the opening of the door monitored by the door security device to automatically disarm the security system, as long as it has been preceded by the opening of the lock in an appropriate manner, i.e. for at least a certain predetermined time. In this manner, a "kick-in" of the door will not cause the system to disarm, but would instead sound the alarm, which is advantageous over the prior art.

First, at step 52, the processor 24 will receive the DOOR UNLOCKED interrupt from the lock position detector 20 that indicates that the door has been unlocked; i.e. that it has transitioned from the locked state to the unlocked state. The processor will start a timer process at step 54 and count down a predetermined time, which in the preferred embodiment is 100 msec. At the expiration of the 100 msec period, the door status signal is checked at step 56 to verify that the door is still closed (DOOR CLOSED STATE). Note that if an intruder has forced open the door, then the door status will indicate door open at or about the same time (i.e. within 100 msec) as the lock position being sensed as retracted (the bolt exiting the housing in the doorjamb, or DOOR UNLOCKED state), and the processor will sound the alarm in this event. This forced entry disarm prevention is not found in the prior art. In addition, the 100 msec delay is useful in debouncing the switch and ensuring that transient signals are not falsely detected.

Assuming that the door is still closed after the 100 msec window has expired (DOOR CLOSED state), then the processor will set a "DISARM READY" flag at step 60, but will not disarm the security system at that time. Instead, the processor will wait (step 62 and 50) for the door status to change from closed to open (step 68), and then check the state of the DISARM READY flag (step 70). If the flag is set, then the processor will issue a system disarm message, which will be sent by the transmitter 26 to the control panel (step 72), which will operate on it in the normal course of procedure. If, however, the flag has been cleared (step 66) before the door is opened, then the processor will not disarm the system but instead would send an alarm message (step 58). This may occur if a person turns the key to retract a deadbolt, for example, and then changes his or her mind and re-locks the door without opening it (step 64). Since turning the key to retract the deadbolt will set the DISARM READY flag (after 100 msec), a subsequent forced entry of the door in this scenario would disarm the system if the flag weren't cleared by the re-locking of the door by the user. Thus, implementation of the disarm ready flag is another safety measure in the present invention.

When the lock status changes to indicate that the lock has been retracted (DOOR UNLOCKED) (step 52), and the door status indicates that the door is open at the time that the 100 msec period has elapsed (DOOR OPEN) (step 56), then the system will not disarm and, instead, an alarm message is generated and transmitted to the control panel for processing (step 58). The control panel will then not allow disarming of the system via any door security lock in the system, but preferably will require the entry of a user code on a keypad or remote keyfob, which will transmit the user code to the control panel and then disarm the system. Since an intruder might kick in the door and then attempt to open another door from inside having a door security lock in order to disarm the system (which would be an easy task from the inside), the control panel will ignore disarm messages from a door security device when it has been alarmed (by any security device in the system).

Figure 5:
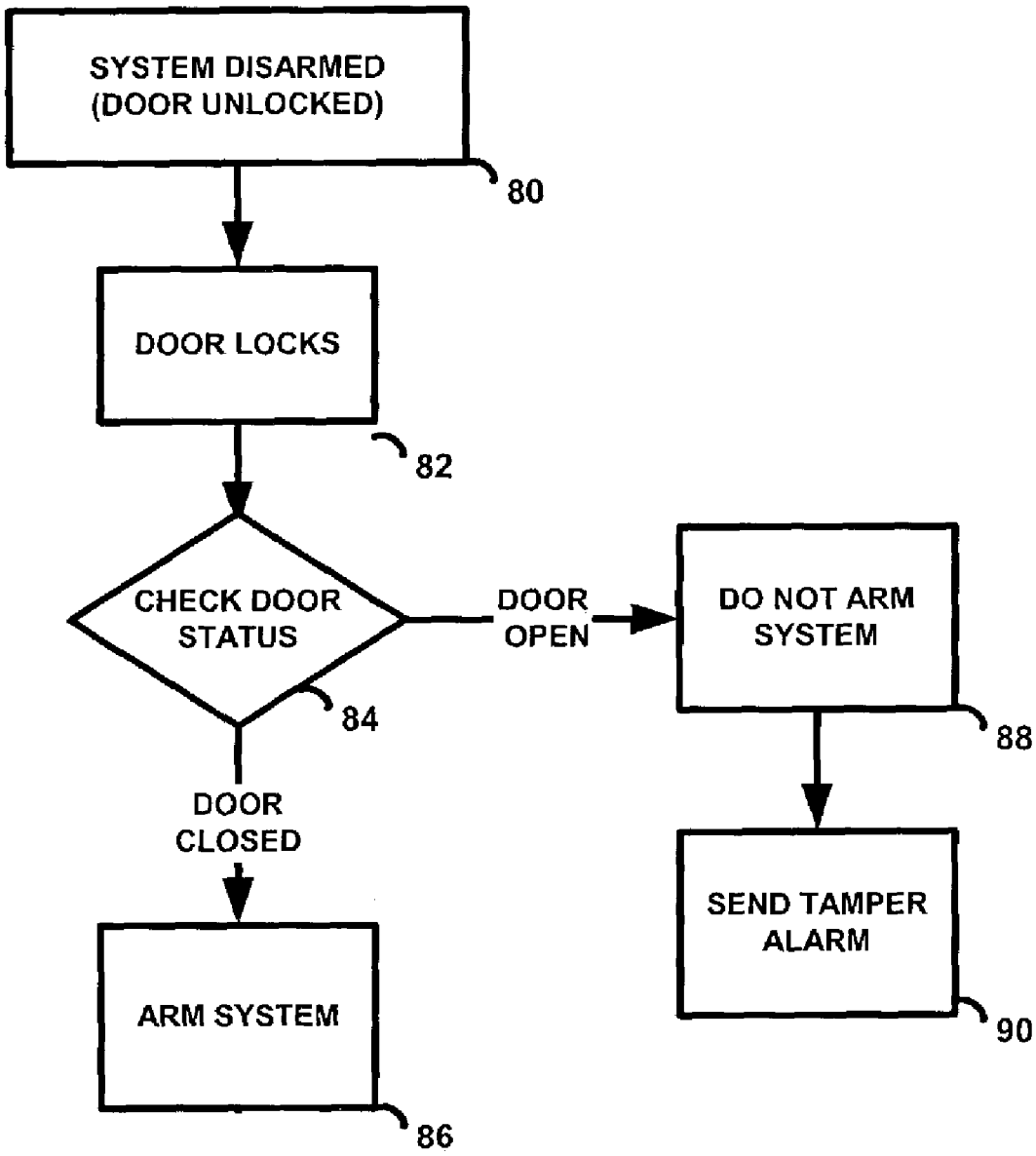
FIG. 5 is a flowchart of the arming operation of the present invention.

With respect to FIG. 5, in the next scenario, the system is in the disarmed state (step 80), and the door security lock may be used to arm the system automatically. When the system is disarmed, and the door lock is closed (i.e. the bolt is extended and the DOOR LOCKED signal is generated) (step 82), then the processor will send a system arm message (step 81) to the control panel as long as the door position sensor indicates that the door is in the closed position (DOOR CLOSED) (step 84). That is, if the door is in the open position (DOOR OPEN), the system arm message will not be sent (step 88), since the system should not be armed by the bolt closing when the door is open. This may occur if someone is tampering with the lock position detector switch while the door is open, such as by inserting an object into the bolt cup to falsely trigger the switch. If this occurs, then a tamper alarm message (step 90) is sent to the control panel.

It will be apparent to those skilled in the art that modifications to the specific embodiment described herein may be made while still being within the spirit and scope of the present invention. For example, the door security device is preferably encased within a single housing suitable for retrofit into an existing recess of a doorjamb, but the device may be integrated into a doorjamb, or even into the door itself, in other ways (e.g. multiple housings). Various types of detectors may be used to determine the position of the lock bolt as well as the position of the door with respect to the doorjamb.

What is claimed is:

1. A method of operating a security system comprising an entry door and a lock for selectively locking and unlocking the entry door, comprising the steps of:

sensing the position of the lock as being locked or unlocked;

detecting the position of the door as being open or closed;

generating a door status signal that indicates whether the door has been detected as being opened or closed; and generating a security system disarm signal when (i) the position of the lock is sensed to have transitioned from a locked state to an unlocked state, (ii) the door status signal indicates that the door is closed at the time that a predefined time period has elapsed since the position of the lock is sensed to have transitioned from a locked state to an unlocked state; and (iii) the door status signal indicates that the door has been opened after the predefined time period has elapsed.

2. The method of claim 1 comprising the further step of generating an alarm signal when (i) the position of the lock is sensed to have transitioned from a locked state to an unlocked state, and (ii) the door status signal indicates that the door is open at the time that the predefined time period has elapsed.

3. The method of claim 2 wherein, when an alarm signal is generated, the system is prevented from being disarmed unless a user code is entered into the security system.

4. The method of claim 1 comprising the further step of setting a disarm ready flag when the door status signal indicates that the door is closed at the time that a predefined time period has elapsed since the position of the lock is sensed to have transitioned from a locked state to an unlocked state.

5. The method of claim 4 further comprising the step of clearing the disarm ready flag if the position of the lock is sensed to have transitioned from an unlocked state to a locked state before the door status signal indicates that the door has been opened.

6. The method of claim 5 wherein the disarm ready flag must be set in order for the security system disarm signal to be generated.

7. The method of claim 1 comprising the further step of arming the security system when the position of the door is detected as being closed and the position of the lock is sensed to have transitioned from an unlocked state to a locked state.

8. The method of claim 1 wherein the predefined time period is 100 msec.

9. The method of claim 1 wherein the security system disarm signal is sent to a security system control panel, and wherein the security system control panel disarms the security system on receipt of the security system disarm signal.

10. The method of claim 9 wherein the security system disarm signal is sent by wireless transmission to the security system control panel.

11. The method of claim 9 wherein the security system disarm signal is sent by wired transmission to the security system control panel.

12. The method of claim 9 wherein the security system control panel does not disarm the security system on receipt of the security system disarm signal if the security system is in an alarmed state.

13. A door entry security device comprising:

a housing;

a lock position detecting switch within the housing, adapted to detect the position of a lock mounted on a door associated with a doorjamb as being either locked or unlocked with respect to the doorjamb;

a door position detecting switch within the housing, adapted to detect the position of the door as being either open or closed with respect to the doorjamb and to generate a door status signal that indicates whether the door has been detected as being open or closed;

processing circuitry adapted to generate a security system disarm signal when the lock position detecting switch indicates that the position of the lock has transitioned from a locked state to an unlocked state, the door status signal indicates that the door is closed at the time that a predefined time period has elapsed since the position of the lock is sensed to have transitioned from a locked state to an unlocked state; and the door status signal indicates that the door has been opened after the predefined time period has elapsed.

14. The device of claim 13 wherein the processing circuitry is further adapted to generate an alarm signal when the lock position detecting switch indicates that the position of the lock has transitioned from a locked state to an unlocked state, and the door status signal indicates that the door is open at the time that the predefined time period has elapsed.

15. The device of claim 13 wherein the processing circuitry is further adapted to set a disarm ready flag when the door status signal indicates that the door is closed at the time that a predefined time period has elapsed since the lock position detecting switch indicates that the position of the lock has transitioned from a locked state to an unlocked state.

16. The device of claim 15 wherein the processing circuitry is further adapted to clear the disarm ready flag if the lock position detecting switch indicates that the position of the lock has transitioned from an unlocked state to a locked state before the door status signal indicates that the door has been opened.

17. The device of claim 16 wherein the disarm ready flag must be set in order for the security system disarm signal to be generated.

18. The device of claim 13 wherein the processing circuitry is further adapted to generate a security system arming signal when the position of the door is detected as being closed and the lock position detecting switch indicates that the position of the lock has transitioned from an unlocked state to a locked state.

19. The device of claim 13 wherein the predefined time period is 100 msec.

20. The device of claim 13 further comprising a wireless transmitter for sending the security system disarm signal to a security system control panel.

21. The device of claim 13 wherein the housing is adapted to mount within a recess of a doorjamb of a premises.

22. The device of claim 13 wherein the housing is adapted to mount within a recess of a door of a premises.

23. The device of claim 13 wherein the lock position detecting switch is a contact switch comprising an arm actuated by the position of the lock.

24. The device of claim 13 wherein the door position detecting switch is a magnetic reed switch and wherein a magnet is located within the door.

25. A security system comprising:

a control panel, and a door entry security device comprising:

a housing;

a lock position detecting switch within the housing, adapted to detect the position of a lock mounted on a door associated with a doorjamb as being either locked or unlocked with respect to the doorjamb;

a door position detecting switch within the housing, adapted to detect the position of the door as being either open or closed with respect to the doorjamb and to generate a door status signal that indicates whether the door has been detected as being open or closed;

processing circuitry adapted to generate a security system disarm signal when the lock position detecting switch indicates that the position of the lock has transitioned from a locked state to an unlocked state, the door status signal indicates that the door is closed at the time that a predefined time period has elapsed since the position of the lock is sensed to have transitioned from a locked state to an unlocked state; and the door status signal indicates that the door has been opened after the predefined time period has elapsed; and a data transmitter for sending the security system disarm signal to the control panel.

26. The system of claim 25 wherein the processing circuitry is further adapted to generate an alarm signal and transmit the alarm signal to the control panel when the lock position detecting switch indicates that the position of the lock has transitioned from a locked state to an unlocked state, and the door status signal indicates that the door is open at the time that the predefined time period has elapsed.

27. The system of claim 26 wherein the control panel prevents the security system from being disarmed when an alarm signal is received unless a user code is entered into the security system.

28. The system of claim 25 wherein the processing circuitry is further adapted to set a disarm ready flag when the door status signal indicates that the door is closed at the time that a predefined time period has elapsed since the lock position detecting switch indicates that the position of the lock has transitioned from a locked state to an unlocked state.

29. The system of claim 28 wherein the processing circuitry is further adapted to clear the disarm ready flag if the lock position detecting switch indicates that the position of the lock has transitioned from an unlocked state to a locked state before the door status signal indicates that the door has been opened.

30. The system of claim 29 wherein the disarm ready flag must be set in order for the security system disarm signal to be generated.

31. The system of claim 25 wherein the processing circuitry is further adapted to generate a security system arming signal when the position of the door is detected as being closed and the lock position detecting switch indicates that the position of the lock has transitioned from an unlocked state to a locked state.

32. The system of claim 25 wherein the predefined time period is 100 msec.

33. The system of claim 25 wherein the control panel disarms the security system on receipt of the security system disarm signal.

34. The system of claim 33 wherein the control panel does not disarm the security system on receipt of the security system disarm signal if the security system is in an alarmed state.

35. The system of claim 25 wherein the data transmitter is a wireless transmitter.

36. The system of claim 25 wherein the housing is adapted to mount within a recess of a doorjamb of a premises.

37. The system of claim 25 wherein the housing is adapted to mount within a recess of a door of a premises.

38. The system of claim 25 wherein the lock position detecting switch is a contact switch comprising an arm actuated by the position of the lock.

39. The system of claim 25 wherein the door position detecting switch is a magnetic reed switch and wherein a magnet is located within the door.

40. A security system for a premises comprising an entry door and a lock for selectively locking and unlocking the entry door, comprising:

means for sensing the position of the lock as being locked or unlocked;

means for detecting the position of the door as being open or closed;

means for generating a door status signal that indicates whether the door has been detected as being opened or closed; and means for generating a security system disarm signal when (iv) the position of the lock is sensed to have transitioned from a locked state to an unlocked state, (v) the door status signal indicates that the door is closed at the time that a predefined time period has elapsed since the position of the lock is sensed to have transitioned from a locked state to an unlocked state; and (vi) the door status signal indicates that the door has been opened after the predefined time period has elapsed.

41. The security system of claim 40 further comprising means for generating an alarm signal when (iii) the position of the lock is sensed to have transitioned from a locked state to an unlocked state, and (iv) the door status signal indicates that the door is open at the time that the predefined time period has elapsed.

42. The security system of claim 41 further comprising means for preventing the system from being disarmed unless a user code is entered into the security system when an alarm signal is generated.

43. The security system of claim 40 further comprising means for setting a disarm ready flag when the door status signal indicates that the door is closed at the time that a predefined time period has elapsed since the position of the lock is sensed to have transitioned from a locked state to an unlocked state.

44. The security system of claim 43 further means for clearing the disarm ready flag if the position of the lock is sensed to have transitioned from an unlocked state to a locked state before the door status signal indicates that the door has been opened.

45. The security system of claim 44 wherein the disarm ready flag must be set in order for the security system disarm signal to be generated.

46. The security system of claim 40 further comprising means for arming the security system when the position of the door is detected as being closed and the position of the lock is sensed to have transitioned from an unlocked state to a locked state.

47. The security system of claim 40 wherein the security system disarm signal is sent to a security system control panel, and wherein the security system control panel comprises means for disarming the security system on receipt of the security system disarm signal.

48. The method of claim 47 wherein the security system control panel does not disarm the security system on receipt of the security system disarm signal if the security system is in an alarmed state.

* * * * *